US005954356A

United States Patent [19]

Busby, Jr. et al.

[11] Patent Number: 5,954,356

[45] Date of Patent: Sep. 21, 1999

[54] SNOWBOARD

[75] Inventors: James Steele Busby, Jr., 247 Knox St., Costa Mesa, Calif. 92627; Mark Patrick Nex, Costa Mesa, Calif.

[73] Assignee: James Steele Busby, Jr., Newport Beach, Calif.

[21] Appl. No.: 08/792,247

[22] Filed: Jan. 31, 1997

[51] Int. Cl.[6] ..... A63C 5/07

[52] U.S. Cl. ..... 280/602; 280/14.2

[58] Field of Search ..... 280/602, 607, 280/608, 609, 610, 14.2, 28

[56] References Cited

U.S. PATENT DOCUMENTS 5,573,264 11/1996 Deville et al. ..... 280/14.2
5,647,605 7/1997 Arduin ..... 280/14.2
5,671,940 9/1997 Abondance ..... 280/602

*Primary Examiner*—Richard M. Camby
*Attorney, Agent, or Firm*—Lyon & Lyon LLP

[57] ABSTRACT

A snowboard that facilitates turn carving has an elongated body with first and second elevated bases mounted thereto, and an area of increased stiffness extending radially from the first and second bases toward the central axis of the body of the snowboard. V-shaped, diamond shaped or T-shaped drive members are mounted to the body or formed integrally therewith to increase the stiffness of the body in the area between the bases. The combination of the elevated bases and area of increased stiffness increases the flex area and the positive running edge of the snowboard. Additional stiffener fingers can be included to extend outwardly from the bases toward the nose and tail ends to provide shock absorption and vibration dampening.

19 Claims, 11 Drawing Sheets

SNOWBOARD

FIELD OF THE INVENTION

This invention relates to a snowboard and more particularly to a snowboard with a drive system that facilitates turning.

BACKGROUND OF THE INVENTION

Whether on skis or a snowboard, everyone wants to be able to carve a turn as they traverse down the ski slope. Carving a turn amounts to putting the skis or snowboard on edge and then shooting through a smooth arc. World cup skiers carve their turns as they thread the gates on a slope. Advanced snowboarders carve turns as they lean deep into the mountain and drive the edge of their boards hard into the slope. Most skiers and snowboarders, however, do not carve their turns, but rather skid their ski or snowboard tails through a scraping turn.

To master the art of turn carving, the snowboarder or skier must drive the snowboard or ski into the slope hard enough to cause it to bend to form the turn carving arc. It follows then that the stiffer the snowboard or ski, the more difficult it will be to turn. Although it will be easier to form a turn carving arc the more flexible the snowboard or ski is made, the snowboard or ski will also be less stable the more flexible the snowboard or ski is made. This decrease in stability is more pronounced in a snowboard because of the snowboard's wide body. As a result of its wide body, the ends of the snowboard will naturally tend to twist before the snowboard bends as the edge of the snowboard is driven into the mountain to make a turn. Thus, as the snowboard becomes more flexible, it will more readily twist and, as a result, more readily vibrate.

To attempt to make the snowboard easier to turn while maintaining its stability, the snowboard has been constructed with parabolic side cuts to form an arcuate turning or running edge. Although the parabolic side cuts currently utilized with conventional snowboards may make the snowboard easier to turn, they are not likely to enable the average snowboarder to readily carve a turn. Because of the configuration of the conventional snowboard, the parabolic side cuts cannot be made drastic enough to significantly reduce the likelihood that the snowboard will skid through a scraping turn instead of holding an edge through a carving arc. For example, if a drastic side cut is incorporated into the snowboard such that the waist or midsection of the board is cut narrower than the length of the snowboarder's feet, the snowboarder's toes or heels will undesirably drag in the snow as the snowboarder turns the snowboard on edge and leans into a turn. If, on the other hand, the width of the ends of the snowboard are increased to provide a more drastic side cut, the torsional forces that cause twisting and vibration during a turn will also increase and make the board less stable.

Parabolic side cuts are also unlikely to enable the average snowboarder to readily carve a turn because a conventional snowboard tends to be inherently incapable of holding an edge through a turn. Because of the lateral spacing of the snowboarder's feet, the portion of the snowboard between the snowboarder's feet will not flex or will tend to flex in a direction opposite to the direction that the snowboard flexes outside of the snowboarder's feet as the snowboarder attempts to turn the snowboard. This non-flex or counter directional flex results in a negative running edge between the snowboarder's feet. In conventional snowboards, the ratio of a positive running edge located outside the snowboarder's feet to a negative running edge located between the snowboarder's feet is approximately 1–1.5:1.

Because of the relative size of a conventional snowboard's negative running edge, the negative running edge tends to prevent the snowboard from following a path defined by a turn carving arc and tends to counteract the influence of the parabolic side cut. Thus, the conventional snowboard is not likely to enable the average snowboarder to carve a turn with any predictability.

Therefore, it would be desirable to have a snowboard that facilitates turn carving by increasing the ratio of the positive running edge to the negative running edge without reducing the snowboard's stability, that provides better edge hold through a turn, that performs more predictably and, additionally, that tends to reduce vibration in the end of the snowboard during turning.

SUMMARY OF THE INVENTION

The snowboard of the present invention serves to facilitate turn carving by increasing the ratio of the positive running edge of the snowboard to the negative running edge of the snowboard without reducing the snowboard's stability. Furthermore, the snowboard of the present invention provides better edge hold through turns, performs more predictably and tends to reduce vibration in the end of the snowboard during turning. The snowboard preferably comprises an elongated body having turned up nose and tail ends and first and second bases mounted in spaced relation on the body on opposite sides of the central axis of the snowboard. The first and second bases can be mounted to the snowboard along with bindings utilizing the conventional mounting holes of a conventional snowboard. The first and second bases preferably elevate the snowboarder's boots captured in the bindings above and in spaced relation with the body of the snowboard. The stiffness of the area of the snowboard between the bases is preferably increased by mounting V-shaped, diamond-shaped, or T-shaped drive members to the body or integrally forming the V-shaped or T-shaped members with the body. By elevating the snowboarder's boots and increasing the stiffness of the body between the first and second bases, the flex area and positive running edges of the snowboard are increased as compared to a conventional snowboard. The positive running edge on the snowboard of the present invention tends to extend toward the central axis of the snowboard beyond the first and second bases resulting in the formation of a smooth carving arc during turning of the snowboard. Additionally, stiffener fingers that extend from the first and second bases toward the ends of the nose and tail sections are added to provide shock absorption and vibration dampening. The stiffener fingers can be mounted on the body or formed integrally therewith.

An object of this invention is to provide an improved snowboard.

Further objects and advantages of the present invention will become apparent from a consideration of the drawings and ensuing description.

DESCRIPTION OF THE PRIOR ART

Figure 1:
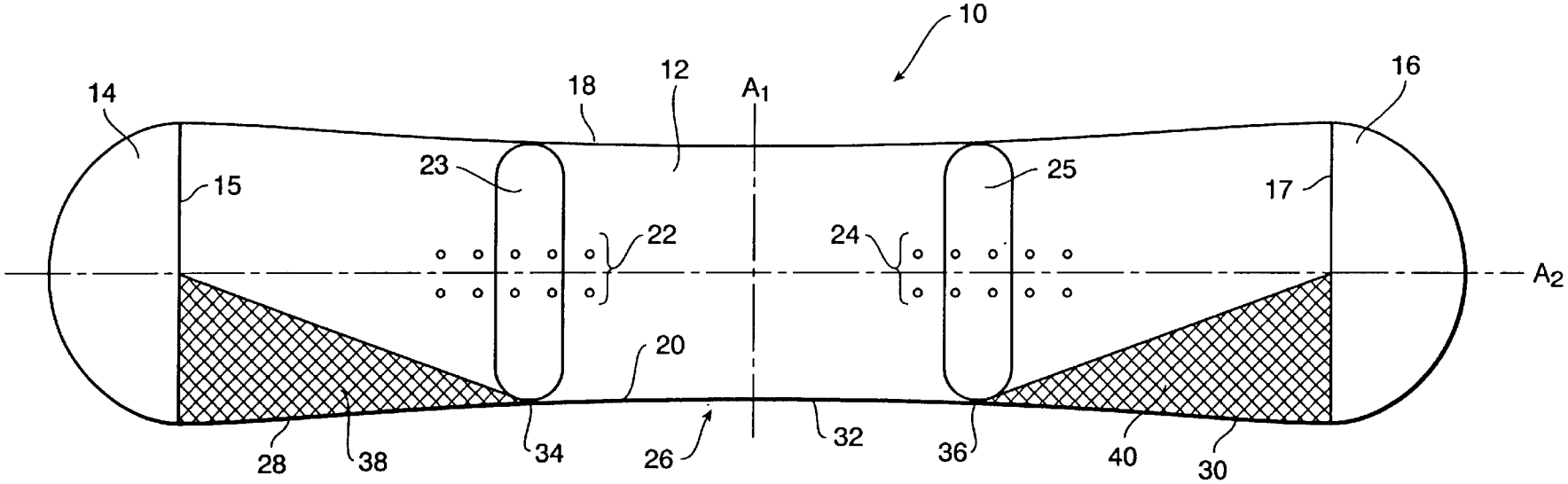
FIG. 1 (Prior Art)
FIG. 1 is a top view of a conventional snowboard known in the art.
Figure 2:
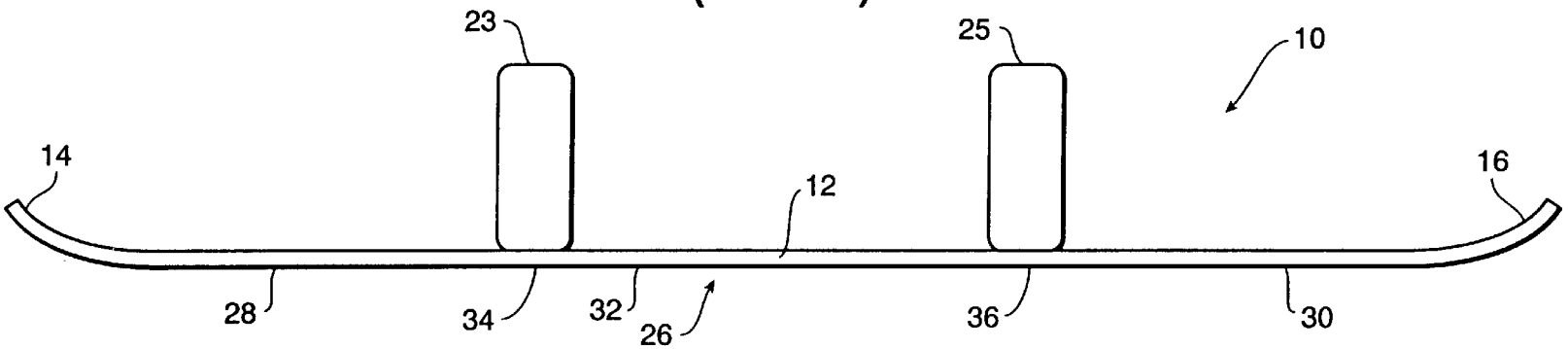
FIG. 2 (Prior Art)
FIG. 2 is an elevation view of the conventional snowboard in FIG. 1.
Figure 3:
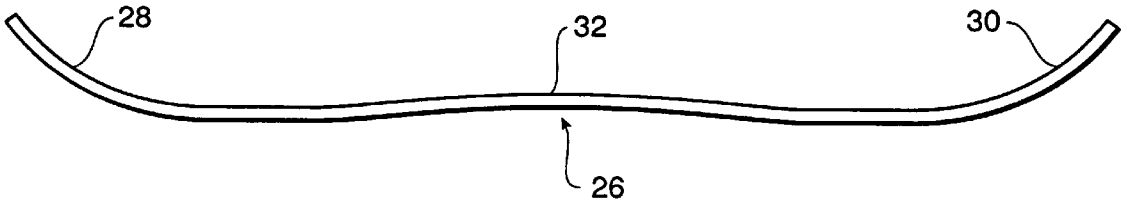
FIG. 3 (Prior Art)
FIG. 3 is a schematic showing the shape of a running edge of the conventional snowboard during turning.

Referring now in detail to FIGS. 1–3, therein illustrated is a conventional snowboard 10 known in the art. The snowboard 10 typically comprises an elongated planar body 12 having arcuate or parabolically cut sides 18 and 20. The body 12 is generally wider than a conventional alpine ski known in the art. The ends 14 and 16 of the nose and tail of the body 12 tend to be curved upwardly at bend lines 15 and 17. Two groups of mounting holes 22 and 24 are positioned in spaced relation and on opposite sides of the central axis A1 of the snowboard 10 and tend to straddle the longitudinal axis A2 of the snowboard 10. Bindings (not shown) which capture boots 23 and 25 are mounted to the snowboard 10 using mounting holes 22 and 24. The boots 23 and 25 are shown schematically to illustrate the typical spacing between boot 23 and 25 locations on conventional snowboards 10.

To perform a turn, the snowboarder turns the snowboard 10 on its running edge 26 and leans into the turn. By leaning, the snowboarder applies a load to the body 12 of the snowboard 10 at points 34 and 36 along the running edge 26 adjacent to the toe end of the boots 23 and 25. This load causes the body 12 of the snowboard 10 to flex in the cross-hatched areas 38 and 40 between respective load points 34 and 36 and the bend lines 15 and 17 of the ends 14 and 16. The flex of the body 12 of the snowboard 10 includes a twisting motion around the longitudinal axis A2 and a bending motion around the central axis A1. When referring to FIG. 2, the bending motion will direct the ends 14 and 16 in an upwardly direction forming arcs that are directed downwardly. However, the central portion of the body 12 of the snowboard 10, located between the boots 23 and 25, will either tend not to flex or will tend to bend in a direction opposite to the direction that the ends 14 and 16 bend, i.e., when referring to FIG. 2, the central portion of the body 12 between the boots 23 and 25 will bend forming an arc directed upwardly, if it bends at all.

Figure 4:
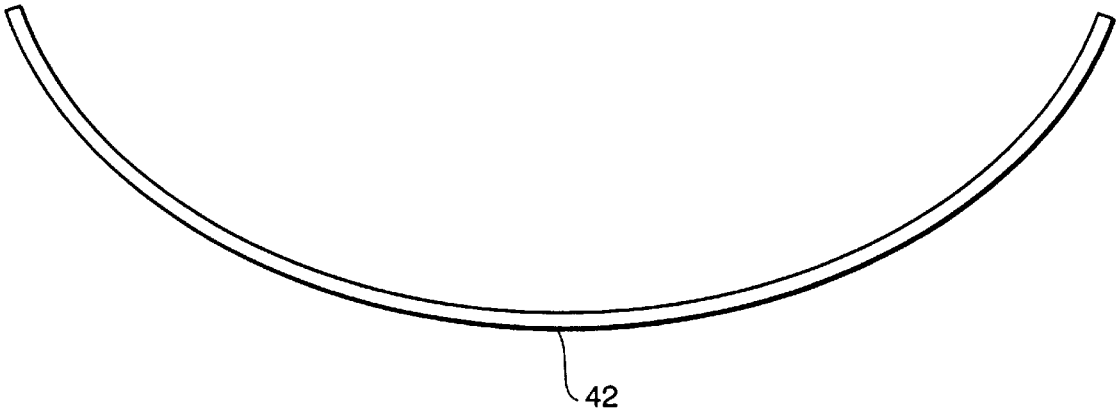
FIG. 4 is a schematic of an ideal turn-carving arc for a conventional snowboard.
Figure 5:
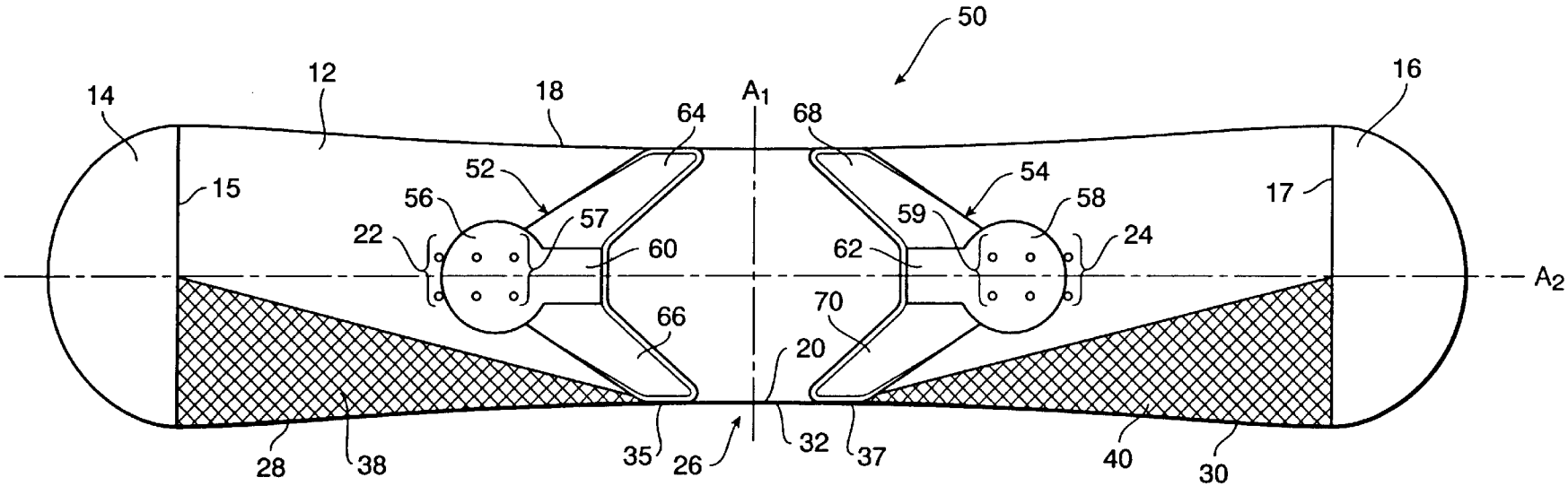
FIG. 5 is a top view of a novel V-drive snowboard of the present invention.

The flex areas 38 and 40 define areas of a positive running edge 28 and 30 along the running edge 26. The positive running edges 28 and 30 are smooth shaped arcs which guide the snowboard in a turn (see FIG. 3). However, the area between the boots 23 and 25 defines a negative running edge 32. The negative running edge 32 is either flat or slightly curved in an opposite direction to the positive running edges 28 and 30 as shown in FIG. 3, and tends to prevent the snowboard 10 from holding an edge through a turn defined by an arcuate path. Thus, the shape of the running edge 26 during a turn, as shown in FIG. 3, causes the conventional snowboard 10 to slide or skid through a turn rather than following a defined path through a smooth turn carving arc, as defined by the turn carving arc 42 shown in FIG. 4.

In a conventional snowboard, the ratio of positive running edge to negative running edge is approximately 1–1.5:1. As this ratio decreases, the snowboard is more likely to skid or slide through a turn. However, as this ratio increases, the shape of the running edge 26 during a turn will more closely resemble the smooth turn carving arc 42 shown in FIG. 4, and thus will more likely carve a turn rather than skidding or sliding through a turn.

DESCRIPTION OF THE PREFERRED EMBODIMENT

Referring now in detail to FIGS. 5–9, therein illustrated is a preferred embodiment of a V-drive snowboard 50 of the present invention. The V-drive snowboard 50 comprises V-drives 52 and 54 mounted on a conventional snowboard. Accordingly, like components will be identified with the same numerals.

Figure 9:
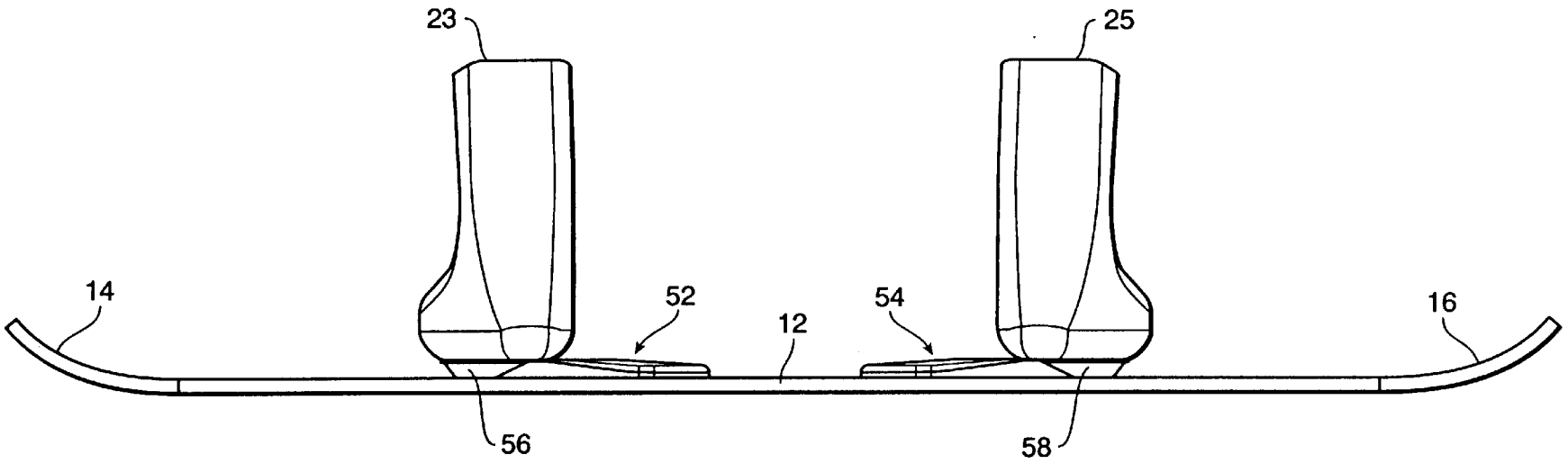
FIG. 9 is an elevation view of the V-drive snowboard in FIG. 5.

The V-drives 52 and 54 comprise torsional bases 56 and 58 and V-plates 60 and 62 extending therefrom toward the central axis A1 of the V-drive snowboard 50. The V-plates 60 and 62 comprise radially extending stiffener fingers 64 and 66, 68 and 70 that extend respectively from the torsional bases 56 and 58 inwardly toward the central axis A1 of the snowboard 50 and outwardly toward the side edges 18 and 20 of the body 12 of the V-drive snowboard 50. The torsional bases 56 and 58 of the V-drives 52 and 54 include mounting holes 57 and 59 which allow the V-drives 52 and 54 to be mounted with boot bindings onto a conventional snowboard utilizing the existing mounting holes 22 and 24. By utilizing the existing mounting holes 22 and 24 the V-drive snowboard 50 preserves the conventional mounting locations for the bindings and the conventional positioning of a snowboarder's boots 23 and 25. The fingers 64, 66, 68 and 70 can also be fixed to the body 12 with epoxy or simply bolted. As shown in FIG. 9, the torsional bases 56 and 58 are advantageously elevated to raise the snowboarder's boots 23 and 25 above the body 12 of the V-drive snowboard 50. A compressive material (not shown) could be mounted between the boots 23 and 25 and the body 12 to prevent snow and ice from packing in between the elevated mount and the body 12 of the snowboard 50.

Figure 6:
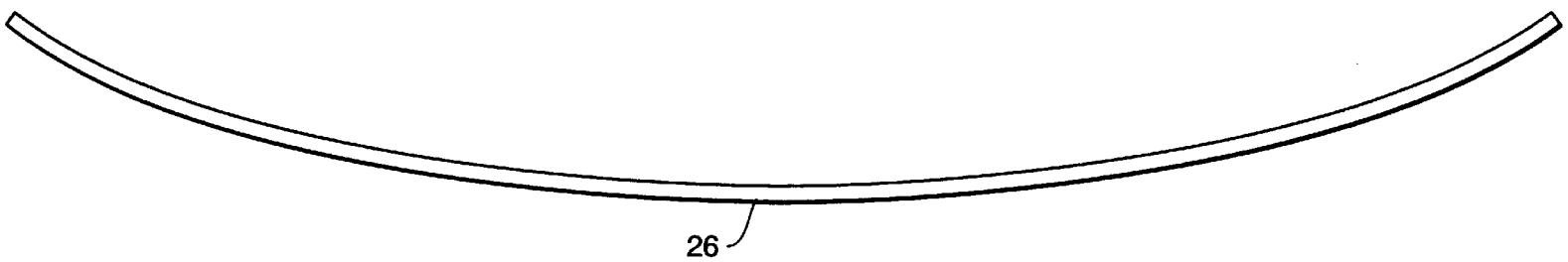
FIG. 6 is a schematic showing the shape of the running edge of the V-drive snowboard in FIG. 5 during turning.
Figure 7:
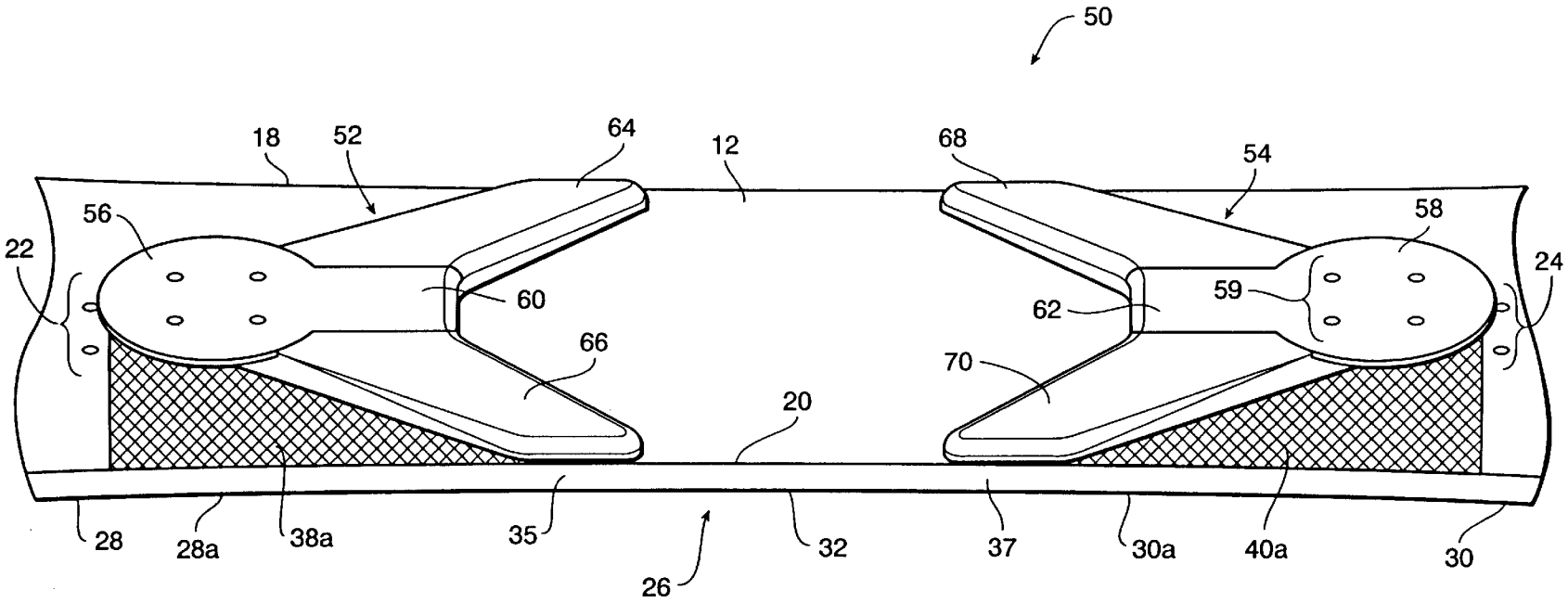
FIG. 7 is a partial top view of the V-drive snowboard in FIG. 5.
Figure 8:
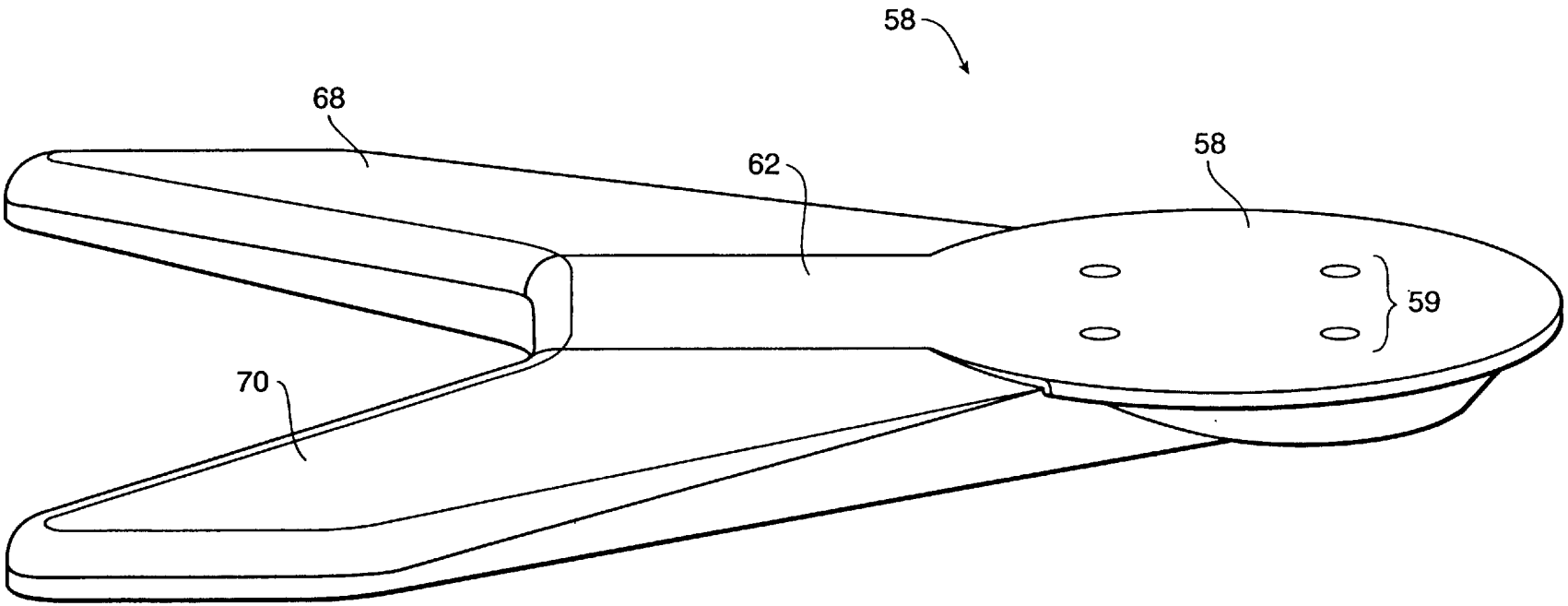
FIG. 8 is an isometric view of a V-drive member of the V-drive snowboard in FIG. 5.

To turn, the snowboard 50 is turned on its running edge 26 as the snowboarder leans to drive the running edge 26 into the slope. By leaning, the snowboarder causes a torque to be applied at torsional bases 56 and 58 of the V-drives 52 and 54 to the body 12 of the snowboard 50 about the snowboard's 50 longitudinal axis A2. The V-drives 52 and 54 advantageously apply a load through the stiffener fingers 66 and 70 of the V-plates 60 and 62 along the running edge 26 of the body 12 at load points 35 and 37. If the snowboard was turned on the snowboard's opposite running edge along the opposite side edge 18 to turn the snowboard in the other direction, a similar torque would be applied at the torsional bases 56 and 58 and the V-drives 52 and 54 would advantageously apply a load through the stiffener fingers 64 and 68 along the opposite running edge at load points similarly located adjacent the ends of the fingers 64 and 68. As compared to the conventional snowboard 10 (FIG. 1), the V-drives 52 and 54 advantageously direct the load applied by the snowboard during a turn to load points 35 and 37 that are much closer to the central axis A1 than the load points 34 and 36 of the conventional snowboard 10 (see FIG. 2). Because the snowboarder's boots 23 and 25 are elevated and the load points 35 and 37 are applied closer to the central axis A1, the body 12 of the V-drive snowboard 50 flexes an additional amount as shown by the cross-hatched areas 38A and 40A in FIG. 7. The increased flex areas 38A and 40A increase the length of positive running edges 28 and 30 along the running edge 26 at edge portions 28A and 30A. The ratio of a positive running edge, which causes the snowboard to follow an arc defined path, to a negative running edge, which causes the snowboard not to follow an arc defined path, is far greater using the V-drive snowboard 50. As shown in FIG. 6, the turning shape of the running edge 26 of the V-drive snowboard 50 is a substantially smooth turn-carving arc. The turn-carving arc shape of the running edge 26 causes the V-drive snowboard 50 to follow a path defined by the arc rather than sliding throughout the turn.

As a result of its construction, the V-drive snowboard 50 is more responsive and its performance is more predictable. By elevating the snowboarder's boots 23 and 25 above the body 12, the snowboarder has greater leverage to make more aggressive turns. By directing the load toward the central axis A1 of the snowboard 50, the running edge 26 of the snowboard 50 more easily deforms into a smooth turn carving arc, which results in more precise turns, less slide, and better edge hold through the turn.

In addition, a more drastic side cut can be incorporated with the V-drive snowboard 50. Because the snowboarder's boots are elevated from the body 12, the waist or midsection of the body 12 can be made narrower without causing the snowboarder's feet to drag during a turn. A more drastic side cut will further enhance the turn-carving characteristics of the V-drive snowboard 50.

Figure 10:
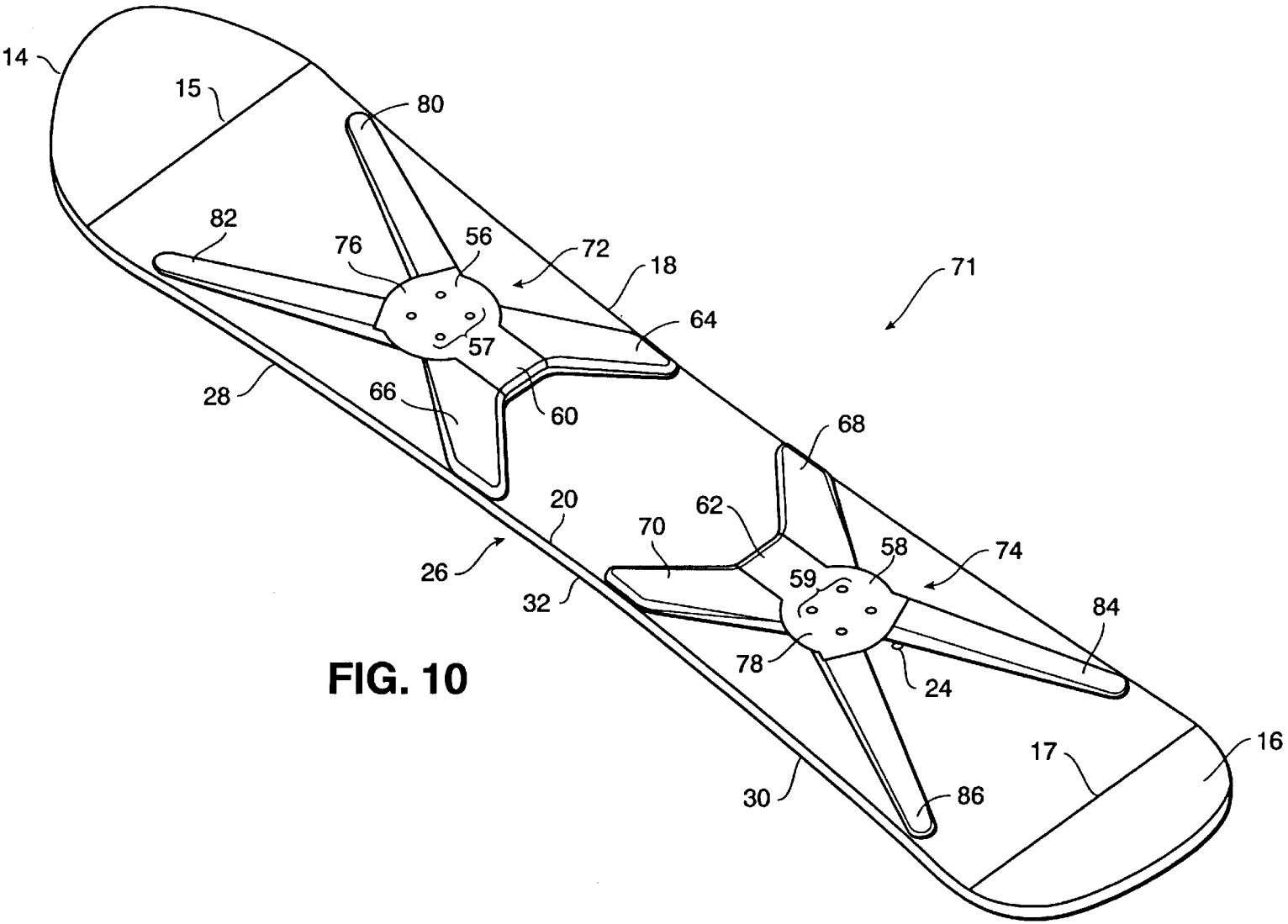
FIG. 10 is an isometric view of an X-drive snowboard of the present invention.
Figure 11:
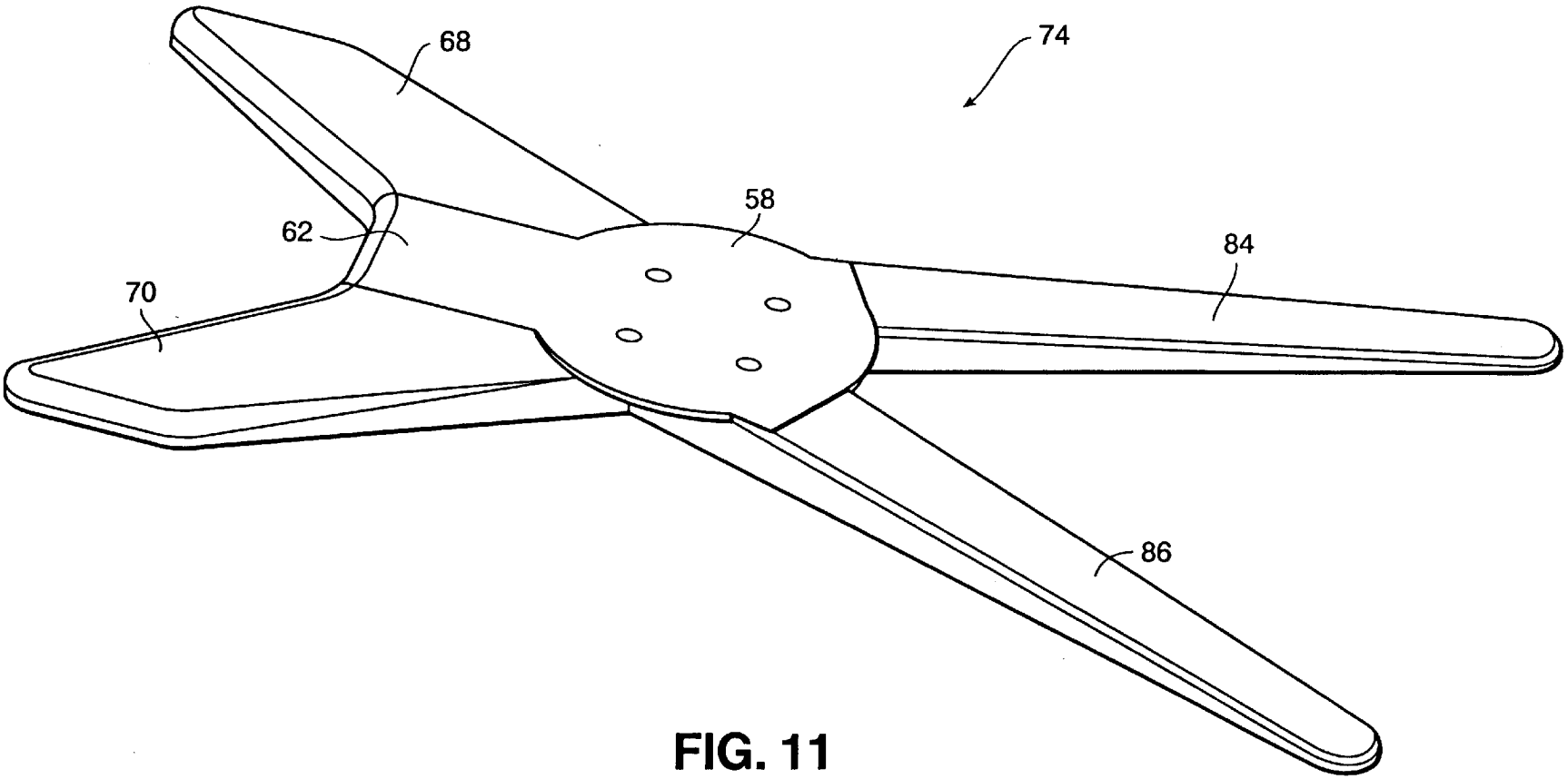
FIG. 11 is an isometric view of an X-drive member of the X-drive snowboard in FIG. 10.

Referring to FIGS. 10 and 11, an X-drive snowboard 71 incorporates the advantages and characteristics of the V-drive snowboard 50 while adding shock absorption and/or vibration dampening characteristics to the snowboard. The X-drive snowboard 71 comprises opposing X-drives 72 and 74 which include the torsional bases 56 and 58 and V-plates 60 and 62 of the V-drives shown in FIGS. 5 and 7–9. The X-drives 72 and 74 also include X-plates 76 and 78 having stiffening fingers 80 and 82, 84 and 86 that radially extend outwardly from the torsional bases 56 and 58 toward the sides 18 and 20 of the body 12 adjacent the ends 14 and 16 of the nose and tail of the X-drive snowboard 71.

In operation, the stiffener fingers 80 and 82, 84 and 86 of the X-plates 76 and 78 will act as shock absorbers and/or vibration dampeners. As the board bends or twists as it flexes during turning or other operations, shearing occurs between the body 12 of and the fingers 80 and 82, 84 and 86. The buildup of friction between the X-plates 76 and 78 and the body 12 of the snowboard 71 advantageously causes a dampening of the vibration of the snowboard 71. Thus, the running edge 26 of the X-drive snowboard 71 can be driven into the snow with more force than with the V-drive snowboard 50. In addition, the X-plates 76 and 78 advantageously tend to reduce the concentration of stress along the running edge 26 at the load points 35 and 37 adjacent the end of the stiffener fingers 66 and 70 of the V-drives 52 and 54.

Figure 12:
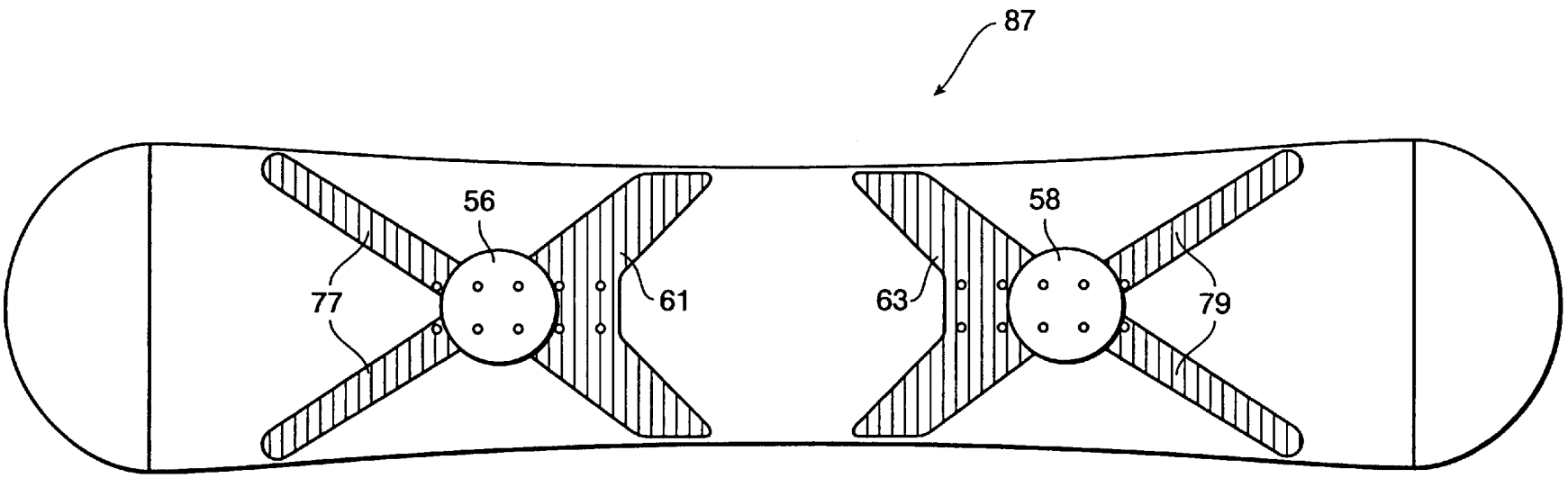
FIG. 12 is a top view of an integrated X-drive snowboard.
Figure 13:
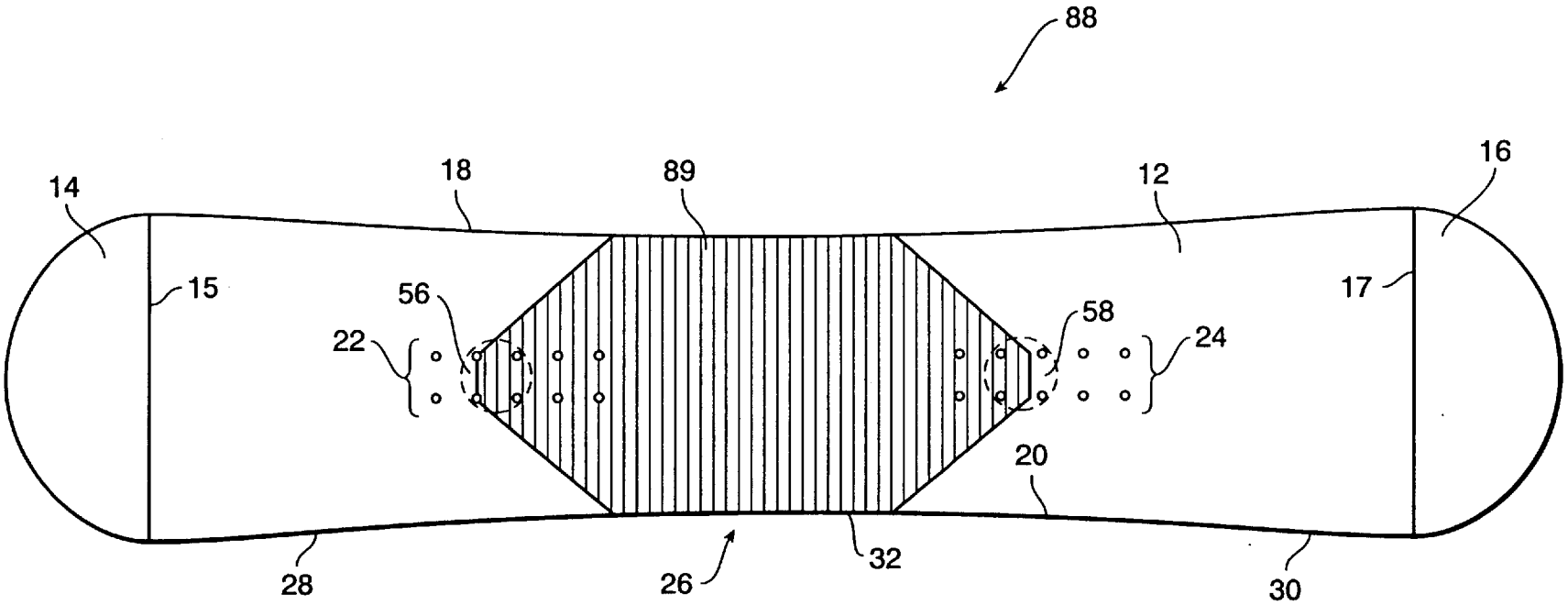
FIG. 13 is a top view of an integrated diamond-drive snowboard.

The V-drive and X-drive snowboards 50 and 71 shown in FIGS. 5–11 include V- and X-drives 52, 54, 72 and 74 that are mountable to conventional snowboards. Referring to FIG. 12, the same advantages and characteristics of these V- and X-drives 52, 54, 72 and 74 could be provided in an integrated snowboard 87 by increasing the stiffness of the cross-hatched areas 61, 63, 77 and 79. By increasing the stiffness in the cross-hatched areas 61, 63, 77 and 79, the flex areas and positive running edges of the snowboard 87 are thereby increased. The stiffness of the cross-hatched areas 61, 63, 77 and 79 of the snowboard 87 can be increased by utilizing a special layup or internal stiffeners. Thus, the combination of these areas of increased stiffness with the elevation of the snowboarder's boot on torsional base mounts 56 and 58 will provide the same or similar benefits experienced with the externally mounted V- and X-drive snowboards 50 and 71.

Turning to FIG. 12, a diamond drive snowboard 88 comprises a diamond drive stiffener 89 embedded in the body 12 of the snowboard 88. As with the V-drive snowboard 50, the diamond drive 89 will direct the turning torque applied at the elevated torsional bases 56 and 58 (shown in phantom) toward the central axis of the snowboard 88. Thus, the diamond drive snowboard 88 will have an increased flex area that will result in a larger positive running edge 28 and 30, which will provide better turning characteristics.

Figure 14:
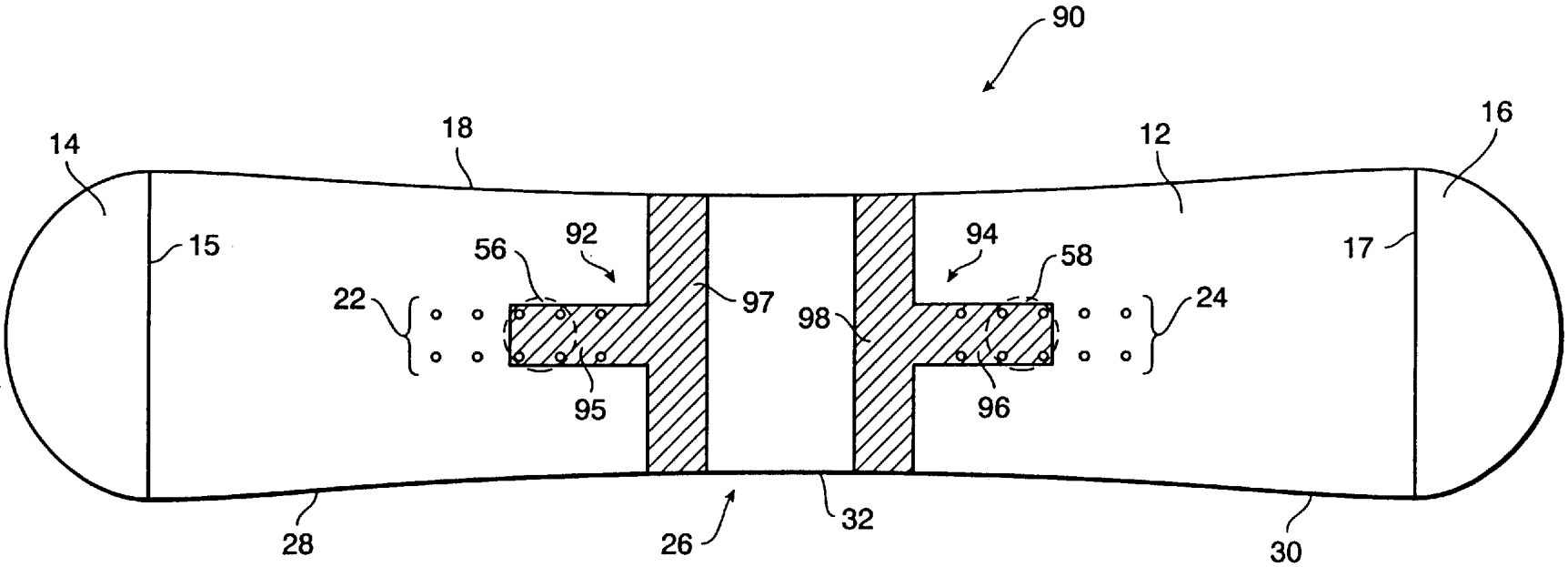
FIG. 14 is a top view of an integrated T-drive snowboard.

Similarly, a T-drive snowboard 90, shown in FIG. 14, will also provide an increased flex area in the body 12 of the T-drive snowboard 90 that will result in a larger positive running edge 28 and 30. The T-drive snowboard 90 comprises T-drives 92 and 94 integrated into the body 12. The T-drives 92 and 94 include stem stiffeners 95 and 96 extending toward the central axis of the snowboard 90 from elevated torsional bases 56 and 58 (shown in phantom) and cross-bar stiffeners 97 and 98 extending outwardly to the sides 18 and 20 of the body 12 of the T-drive snowboard 90 adjacent the central axis.

While the above description contains many specificities, these should not be construed as limitations on the scope of the invention, but rather as an exemplification of one preferred embodiment thereof. Other variations are possible.

Accordingly, the scope of the present invention should be determined not by the embodiments illustrated above, but by the appended claims and their legal equivalents.

What is claimed is:

1. A snowboard comprising an elongated body having central and longitudinal axes, nose and tail ends, first and second side edges extending between said nose and tail ends, and first and second mounting positions for boot bindings located in spaced relation on opposite sides of said central axis, each of said first and second side edges comprising a positive running edge and a negative running edge, and a drive member adapted to direct a turning load toward said central axis of said body to increase said positive running edge of at least one of said first and second side edges such that said positive running edge extends inwardly from said nose and tail ends toward said central axis beyond said first and second mounting positions, said drive member extending from said first and second mounting positions radially outwardly toward said first and second side edges as said drive member extends radially inwardly toward said central axis, said drive member being formed integrally with said body creating an increased stiffening of said body between said first and second mounting positions.

2. A snowboard comprising an elongated body having central and longitudinal axes, nose and tail ends, first and second side edges extending between said nose and tail ends, and first and second mounting positions for boot bindings located in spaced relation on opposite sides of said central axis, each of said first and second side edges comprising a positive running edge and a negative running edge, and a drive member adapted to direct a turning load toward said central axis of said body to increase said positive running edge of at least one of said first and second side edges such that said positive running edge extends inwardly from said nose and tail ends toward said central axis beyond said first and second mounting positions, said drive member extending from said first and second mounting positions radially outwardly toward said first and second side edges as said drive member extends radially inwardly toward said central axis said drive member including first and second bases extending upwardly from said body in spaced relation on opposite sides of said central axis of said body at said first and second mounting positions.

3. The snowboard of claim 2, further comprising compressive material mounted to said body adjacent said first and second bases.

4. A snowboard comprising an elongated body having central and longitudinal axes, nose and tail ends, first and second side edges extending between said nose and tail ends, and first and second mounting positions for boot bindings located in spaced relation on opposite sides of said central axis, each of said first and second side edges comprising a positive running edge and a negative running edge, and a drive member adapted to direct a turning load toward said central axis of said body to increase said positive running edge of at least one of said first and second side edges such that said positive running edge extends inwardly from said nose and tail ends toward said central axis beyond said first and second mounting positions, said drive member extending from said first and second mounting positions radially outwardly toward said first and second said side edges as said drive member extends radially inwardly toward said central axis, said drive member including first and second v-shaped members opposingly extending inwardly from said first and second mounting positions.

5. The snowboard of claim 4, wherein each of said first and second v-shaped members include first and second fingers radially extending from each of said first and second mounting positions inwardly toward the central axis of said body and outwardly toward said first and second side edges.

6. The snowboard of claim 5, further comprising third and fourth fingers radially extending outwardly from each of said first and second V-shaped members toward said nose and tail ends of said body.

7. The snowboard of claim 5, wherein said drive member comprises a generally diamond shaped member extending between said first and second mounting positions.

8. A snowboard comprising a body having first and second side edges, first and second boot binding mounting positions located in spaced relation on said body on opposite sides of a central axis of said body, first and second positive running edges extending along at least one of said first and second side edges toward said central axis of said body beyond said first and second mounting positions, first and second drive members extending from said first and second mounting positions toward said central axis as said first and second drive members extend toward said first and second side edges, and an area of increased stiffness extending between said first and second mounting positions and outwardly towards said first and second side edges as said area of increased stiffness extends inwardly from said first and second mounting positions toward said central axis to direct a turning load toward said central axis.

9. A snowboard comprising a body including a central axis and first and second edges, first and second boot binding mounting positions in spaced relation along said body on opposite sides of said central axis, and a drive member extending inwardly from said first and second positions towards said central axis and outwardly towards said first and second edges as said drive member approaches said central axis to direct a turning load toward said central axis, said drive member comprising first and second v-shaped members extending from said first and second mounting positions.

10. The snowboard of claim 9, wherein each of said first and second v-shaped members include first and second fingers radially extending toward the central axis of said body.

11. The snowboard of claim 10, wherein each of said first and second v-shaped members comprise third and fourth fingers radially extending outwardly toward nose and tail ends of said body.

12. A snowboard comprising a body including a central axis and first and second edges, first and second boot binding mounting positions in spaced relation alone said body on opposite sides of said central axis, and a drive member extending inwardly from said first and second positions towards said central axis and outwardly towards said first and second edges as said drive member approaches said central axis to direct a turning load toward said central axis, said drive member comprising a generally diamond shaped member extending between said first and second mounting positions.

13. The snowboard of claim 5 further comprising a plurality of stiffeners extending outwardly from said first and second mounting positions toward nose and tail ends of said body.

14. The snowboard of claim 5, further comprising third and fourth fingers radially extending outwardly from each of said first and second V-shaped members toward said nose and tail ends of said body.

15. The snowboard of claim 1, wherein said drive member comprises a generally diamond shaped member extending between said first and second mounting positions.

16. The snowboard of claim 10, wherein each of said first and second v-shaped members comprise third and fourth fingers radially extending outwardly toward nose and tail ends of said body.

17. A snowboard comprising a body including a central axis and first and second edges, first and second boot binding mounting positions in spaced relation along said body on opposite sides of said central axis, and a drive member extending inwardly from said first and second positions towards said central axis and outwardly towards said first and second edges as said drive member approaches said central axis to direct a turning load toward said central axis, said drive member comprising an area of increased stiffness extending between said first and second mounting positions.

18. The snowboard of claim 17 further comprising a plurality of stiffeners extending outwardly from said first and second mounting positions toward nose and tail ends of said body.

19. A snowboard comprising a body including a central axis and first and second edges, first and second boot binding mounting positions in spaced relation along said body on opposite sides of said central axis, said first and second edges comprising first and second positive running edges extending toward the central axis beyond said first and second mounting positions, and a drive member extending inwardly from said first and second positions towards said central axis and outwardly towards said first and second edges as said drive member approaches said central axis to direct a turning load toward said central axis.

* * * * *

UNITED STATES PATENT AND TRADEMARK OFFICE

CERTIFICATE OF CORRECTION

| | | |
|---|---|---|
| PATENT NO | : | 5,954,356 |
| DATED | : | September 21, 1999 |
| INVENTOR(S) | : | James Steele Busby, Jr., et al. |

It is certified that error appears in the above-identified patent and that said Letters Patent are hereby corrected as shown below:

Column 7, line 14, please insert a comma between "axis" and "said".

Column 8, line 35, please change "alone" to -- along --.

Signed and Sealed this

First Day of May, 2001

*Attest:*

Nicholas P. Godici

NICHOLAS P. GODICI

*Attesting Officer*

*Acting Director of the United States Patent and Trademark Office*